US012478235B2

(12) United States Patent
Fremerey et al.

(10) Patent No.: US 12,478,235 B2
(45) Date of Patent: Nov. 25, 2025

(54) VACUUM CLEANER HAVING ADAPTIVE DIRT IDENTIFICATION AND METHOD FOR OPERATING THE VACUUM CLEANER

(71) Applicant: BSH Hausgeräte GmbH, Munich (DE)

(72) Inventors: Maximilian Fremerey, Saal an der Saale (DE); Simon Richter, Gersfeld (DE); Andreas Seufert, Poppenhausen (DE)

(73) Assignee: BSH Hausgeräte GmbH, Munich (DE)

( * ) Notice: Subject to any disclaimer, the term of this patent is extended or adjusted under 35 U.S.C. 154(b) by 0 days.

(21) Appl. No.: 18/594,267

(22) Filed: Mar. 4, 2024

(65) Prior Publication Data

US 2024/0292989 A1 Sep. 5, 2024

(30) Foreign Application Priority Data

Mar. 3, 2023 (DE) ..... 10 2023 201 965.5

(51) Int. Cl.
*A47L 9/28* (2006.01)
*A47L 9/04* (2006.01)

(52) U.S. Cl.
CPC ..... *A47L 9/281* (2013.01); *A47L 9/0477* (2013.01); *A47L 9/2826* (2013.01); *A47L 9/2842* (2013.01); *A47L 9/2847* (2013.01); *A47L 9/2857* (2013.01)

(58) Field of Classification Search
CPC ..... A47L 9/281; A47L 9/0477; A47L 9/2826; A47L 9/2842; A47L 9/2847; A47L 9/2857; A47L 9/2815
See application file for complete search history.

(56) References Cited

U.S. PATENT DOCUMENTS 5,105,502 A * 4/1992 Takashima ..... A47L 9/2815 356/438
2010/0318232 A1* 12/2010 Tiekoetter ..... A47L 9/2857 700/282
2012/0152280 A1* 6/2012 Bosses ..... A47L 9/2805 134/6

(Continued)

FOREIGN PATENT DOCUMENTS

DE 68913166 T2 5/1994
DE 102007061146 A1 6/2009

(Continued)

*Primary Examiner* — Amine Benlagsir
(74) *Attorney, Agent, or Firm* — Laurence A. Greenberg; Werner H. Stemer; Ralph E. Locher

(57) ABSTRACT

A vacuum cleaner includes a dirt sensor determining a value of an amount of dirt currently being sucked up, a floor sensor indicating a degree of hardness of the surface currently being vacuumed, a display module, and a control module having at least one automatic mode outputting the dirt value on the display module for a degree of hardness below a soft floor limit value, and otherwise determining a reduction value as the dirt value weighted using a weighting value less than one and outputting it on the display module. In a method for operating the vacuum cleaner, the dirt sensor determines the dirt value, the floor sensor determines the degree of hardness, and the control module in the automatic mode outputs the dirt value for a degree of hardness below the soft floor limit value and otherwise outputs the determined reduction value on the display module.

7 Claims, 2 Drawing Sheets

(56) References Cited

U.S. PATENT DOCUMENTS

| | | | | |
|---|---|---|---|---|
| 2016/0000288 | A1* | 1/2016 | Soejima | A47L 9/2847 15/319 |
| 2021/0038041 | A1* | 2/2021 | Pruiett | A47L 11/4019 |

FOREIGN PATENT DOCUMENTS

| | | | | |
|---|---|---|---|---|
| DE | 102015100483 | A1 * | 7/2016 | A47L 5/34 |
| EP | 0372903 | B1 | 2/1994 | |

* cited by examiner

VACUUM CLEANER HAVING ADAPTIVE DIRT IDENTIFICATION AND METHOD FOR OPERATING THE VACUUM CLEANER

CROSS-REFERENCE TO RELATED APPLICATION

This application claims the priority, under 35 U.S.C. § 119, of German Patent Application DE 10 2023 201 965.5, filed Mar. 3, 2023; the prior application is herewith incorporated by reference in its entirety.

FIELD AND BACKGROUND OF THE INVENTION

The invention relates to a vacuum cleaner having a dirt sensor for identifying dirt. The invention also relates to a method for operating the vacuum cleaner.

German Translation DE 689 13 166 T2 of European Patent EP 0 372 903 B1, corresponding to U.S. Pat. No. 5,105,502, discloses a vacuum cleaner which includes a dust sensor device for detecting dust in air that is sucked through an intake passage of the vacuum cleaner in order to generate a dust signal that is indicative of the result of the detection. The vacuum cleaner further includes adjusting an adjusting device for the sensitivity of the dust sensor device for detecting dust in accordance with the control signal, and a differentiating device for detecting the type of object that is to be cleaned by the vacuum cleaner and for generating a differentiating signal indicative of the type of object, wherein the differentiating signal is supplied in use as the control signal to the adjusting device in order to adjust the sensitivity of the dust sensor device.

SUMMARY OF THE INVENTION

It is accordingly an object of the invention to provide a vacuum cleaner having adaptive dirt identification and a method for operating the vacuum cleaner, which overcome the hereinafore-mentioned disadvantages of the heretofore-known devices and methods of this general type and which specify improvements relating to a vacuum cleaner having a dirt sensor.

With the foregoing and other objects in view there is provided, in accordance with the invention, a vacuum cleaner for sucking up dirt from a surface, having:

- a dirt sensor which is configured so as to determine a dirt value, which indicates the amount of dirt currently sucked up,
- a floor sensor which is configured so as to determine a degree of hardness, which indicates a hardness of the currently vacuumed surface,
- a display module, and
- a control module which has at least one automatic mode as a mode and is configured in this mode, for a degree of hardness below a soft-bottom limit value:
- to output the dirt value on the display module, and
- otherwise to determine a reduction value in the form of the dirt value weighted by using a weighting value less than one and to output it on the display module.

Preferred or advantageous embodiments of the invention as well as other categories of the invention are disclosed in the further claims, the description below and the attached figures.

The vacuum cleaner is used or is configured so as during its operation to suck up dirt from a surface. The term "vacuum cleaner" is to be understood broadly here and includes all such cleaning appliances, in particular household vacuum cleaners, floor or handheld vacuum cleaners or robotic vacuum cleaners.

The vacuum cleaner contains a dirt sensor or also a "dirt identification sensor". The dirt sensor is configured so as to determine a dirt value during operation of the vacuum cleaner. The dirt value indicates the amount of dirt currently being sucked up by the vacuum cleaner. A dirt sensor of this type includes, for example, a light barrier having a light source and light sensor; the dirt value is the amount of light arriving at the light sensor. The amount of light is weakened by dirt particles that are sucked through. The more the light is weakened, the more dirt is actively sucked up.

The vacuum cleaner contains a floor sensor. This is configured so as to determine a degree of hardness during operation of the vacuum cleaner. The degree of hardness indicates the hardness of the floor currently being vacuumed using the vacuum cleaner. A hard floor has a lower degree of hardness (for example "0" for a tiled floor) than a soft floor (for example "2" for a carpet). The term "hardness" here refers in particular to a qualitative value such as a floor class, for instance. Such a floor class is, for example, a "hard or smooth floor" (wood/parquet/laminate/PVC/tiles/stone/concrete/glass/ . . . ). Another floor class is, for example, a soft or carpeted floor, pile, fiber or fabric floor. It is assumed here that a smooth or hard floor has a hardness value of zero up to a soft floor limit value (for example "1"). Other or soft floors provide degrees of hardness above the soft floor limit value.

The soft floor limit value can be preset and adapted to the floor sensor or the degree of hardness and can be determined, for example, by empirical tests in order to differentiate between the desired floor classes.

The vacuum cleaner includes a display module. This can be used to display various items of information to a potential user of the vacuum cleaner. The display module contains, for example, lights, a text display, etc.

The vacuum cleaner contains a control module. The control module and thus the vacuum cleaner have at least one (operating) mode, namely an automatic mode. If there are several modes, the vacuum cleaner can be switched between them. The control module or the vacuum cleaner is operated in the modes. When operated in the automatic mode, the control module is configured so as to proceed as follows:

It utilizes the currently determined degree of hardness. For a degree of hardness determined by the floor sensor that is below the soft floor limit value, the control module outputs the dirt value on the display module. In other words, this applies when vacuuming hard floors.

The control module is configured so as to otherwise proceed as follows: "Otherwise" means that the degree of hardness is above the soft floor limit value, i.e. a soft floor is detected or is currently being vacuumed and not a hard floor. In this case, the control module determines a reduction value. This reduction value is formed by weighting (in particular multiplying) the dirt value by a weighting value. The weighting value is less than (the number) one. The control module then outputs the reduction value on the display module in lieu of the dirt value. This process is therefore carried out when a surface in the form of a soft floor is currently being vacuumed.

In so doing, the weighting value is selected in particular as follows: a specific amount of dirt or a corresponding dirt value is assumed, which still occurs when vacuuming a sufficiently cleaned soft floor of a specific degree of hardness. This dirt value (its display to a user) would correspond to a hard floor that has not yet been sufficiently cleaned when vacuuming a hard floor. If the user is actually shown the relevant dirt value when the soft floor is vacuumed, they could assume-based on optimum cleaning of a hard floor—that the soft floor has not yet been sufficiently cleaned. However, this should be avoided in order not to wear out the soft floor through excessive cleaning, because the soft floor is already sufficiently cleaned even in the case of this dirt value. The weighting value is therefore selected so that the dirt value is reduced to a reduction value that corresponds to the dirt value of a sufficiently cleaned hard floor.

This means that the user is also shown a lower "dirt value" (in the form of the reduction value) when vacuuming the soft floor. The user interprets the value as meaning that the soft floor now also appears to be sufficiently clean and they can or will therefore stop vacuuming the soft floor. In other words, the user is shown a simulated lower amount of dirt currently being sucked up when vacuuming the soft floor. In other words, "less dirt" or a "cleaner surface" is simulated on a soft floor. Transferred to the dirt sensor, on a soft floor, its sensitivity, intensity or sensitivity-based on the hard floor—is reduced or adapted to the soft floor.

As a result, a user of the vacuum cleaner is shown a less dirty or better cleaned soft floor compared to the display of a dirt value by the display of the reduction value. As a consequence, this usually means that the user stops vacuuming the soft floor earlier, thus protecting the soft floor.

Optionally, the dirt value and reduction value can also be output in parallel. Other data can also be displayed on the display module, for example floor class, degree of hardness, etc.

In a preferred embodiment, the control module is configured so as to select the weighting value currently to be used as a function of the currently determined degree of hardness. In particular, the higher the degree of hardness, i.e. the softer the corresponding floor, for example the higher the pile of a carpet, the lower the weighting value is selected. In other words, the softer the surface, the more the actual dirt value is lowered or reduced to a smaller reduction value. As a result, less dirt or an even cleaner surface is simulated when the degree of hardness increases, i.e. the floor is softer. This means that particularly soft floors, for example particularly high-pile carpets, appear to be cleaned more quickly and are therefore better protected, while short-pile carpets, which are generally more resistant, are displayed as dirty for longer and are therefore vacuumed for longer and therefore cleaned better. The harder (lower the degree of hardness) a vacuumed surface is, the more realistic the amount of dirt thereon is displayed.

In a preferred embodiment, the control module is configured so as to function as follows: If the dirt value exceeds a dirt limit value, the following procedure is performed: a cleaning performance of the vacuum cleaner is increased for a predeterminable period of time based on an initial value. Alternatively, this can also be done by the reduction value (in lieu of the dirt value) if a dirt limit value is exceeded. The cleaning power is in particular a suction power and/or possibly a power of a cleaning roller of the vacuum cleaner, if such a roller is present, see below. The initial value is the value at which the vacuum cleaner is initially operated, or until the specified excess is reached, when cleaning the surface. In other words, the cleaning power of the vacuum cleaner is increased (without user intervention, for example by operating a power regulator) for a short period of time when the surface is very dirty in order to clean the surface particularly thoroughly. In particular, it returns to the initial value after the end of the time period.

In a preferred embodiment, the vacuum cleaner includes a cleaning roller or the cleaning roller already mentioned above. In particular, this is configured so as in such a way that it is in contact with the surface during operation of the vacuum cleaner, at least when vacuuming a soft floor. The floor sensor is configured so as to determine the degree of hardness based on a current operating value of the cleaning roller. Such an operating value is, for example, the power consumption of a drive motor of the cleaning roller. In this way, a particularly simple floor sensor can be provided.

In a preferred embodiment, the control module has at least two modes and the control module can be switched at least between the automatic mode and a real mode. The vacuum cleaner therefore has at least the two operating modes: automatic mode and real mode. The real mode can also be referred to as "high sensitivity" and the automatic mode as "automatic sensitivity" in relation to the dirt sensor. In the real mode, the control module is configured so as to output the dirt value in lieu of the reduction value on the display module even for degrees of hardness above (greater than or equal to) the soft floor limit value. In this mode, the real dirt value and not the lowered reduction value is always output on the display module, even when vacuuming soft floors. In particular, the reduction value is not used internally in the vacuum cleaner or in the control module in the real mode. A corresponding weighting value or reduction value does not have to be determined at all in this real mode. In the real mode, for example, the cleaning performance is also only controlled based on the dirt value (exceeding the dirt limit value) and not on the basis of the reduction value. This allows the user of the vacuum cleaner to make an actually realistic assessment of the amount of dirt, even on soft floors.

In a preferred embodiment, the display module includes a cleanliness indicator. This indicates when the dirt value falls below a predeterminable clean value. Similar to the above, the reduction value can alternatively be checked to see if it falls below this value. Such a cleanliness indicator is in particular a binary display, for example, a green indicator light, which only lights up when the value falls below the clean value and thus indicates a "clean" or sufficiently cleaned surface. When the corresponding cleanliness indicator lights up or is activated, the user can therefore stop processing the section of the surface that is currently being vacuumed, as it is sufficiently clean.

In a preferred embodiment, the display module includes an information display. This shows contextual information regarding the currently selected mode on the vacuum cleaner. In this way, a user of the vacuum cleaner is informed about the current operating mode or its advantages and disadvantages, for example (protection of carpets/reduction of the dirt display), and can therefore use the selected operating mode according to their wishes.

With the objects of the invention in view, there is concomitantly provided a method for operating the vacuum cleaner according to the invention. In the method, the dirt sensor determines the dirt value. The floor sensor determines the degree of hardness. In the automatic mode, the control module outputs the dirt value on the display module for a degree of hardness below the soft floor limit value; otherwise, it determines the reduction value and outputs this on the display module in lieu of or in addition to the dirt value.

The method and at least some of its possible embodiments as well as the respective advantages have already been explained analogously in connection with the vacuum cleaner according to the invention.

The invention is based on the following findings, observations or considerations and also has the following preferred embodiments. These embodiments are sometimes also referred to as "the invention" for the sake of simplicity. In so doing, the embodiments may also include or correspond to parts or combinations of the above-mentioned embodiments and/or may also include embodiments not previously mentioned.

According to the invention, this results in an adaptive dirt identification sensor.

According to the invention, there is a method, which adapts the intensity of a sensor (dirt sensor) of a cleaning appliance (vacuum cleaner) depending on the surface.

The invention is based on the following observation:

In most vacuum cleaners on the market, the dirt collected during a dry cleaning process-hereinafter referred to as vacuuming—is transported into a so-called dust collection container. Manually operated cleaning appliances such as multi-use hand-held appliances, but also autonomously operating cleaning appliances such as robotic cleaners, have such a dust collection container. A typical "transport route" of the dirt during a cleaning process is, for example, in the case of a multi-use hand-held appliance: Dirt from the surface is collected via a nozzle assembly mounted on the appliance. The dirt is conveyed to a dust separation system via a pipe by using an air/suction flow. There the dirt enters a dust box. The air flow is generated by a fan.

The dirt on the floor of the substrate/surface to be cleaned is collected by a combination of a bristle-covered roller rotating about its own axis (in the nozzle assembly) and an air stream flowing over this roller and directed inwards into the cleaning appliance and transported into the multi-use hand-held device.

Inside the appliance, the dirt is then first separated from the air flow in the dust collection container (dust box) (via a separator vortex and/or filter surfaces) and then stored in the dust collection container.

New types of cleaning appliances also have sensors located between the nozzle assembly and the dust separation system, which can measure the amount of dirt picked up.

If a particularly large amount of dirt is vacuumed up at a point x in the room, the sensor indicates this in a first step, so that in a further step the control unit of the cleaning appliance then increases the cleaning performance at this point—for example by increasing the rotational speed of the fan and/or bristle roller.

The invention is based on the following knowledge:

However, such an across-the-board increase in cleaning performance does not make sense in all areas of a household.

This is because, in addition to automatically adjusting the cleaning performance, the output of the dirt identification sensor of the cleaning appliance is used by the user to check whether an area has already been sufficiently cleaned. Sufficient cleanliness of an area is indicated when only a few to no dirt particles pass the dirt identification sensor.

However, this situation, in which few to no dirt particles pass the sensor, is only possible with very intensive cleaning effort, especially on high-pile carpets, i.e. an unusually large number of double strokes with the cleaning appliance would have to be performed for the normal consumer.

The reason for this lies in the structure of the high-pile carpet: Once dirt has been tracked in, it sinks deeper and deeper into the fibers over time—and even a cleaning appliance having a rotating bristle roller rarely manages to remove all particles in one or two double strokes due to the beating and suction effect of the mechanism and blower. After all, the carpet should not be damaged during cleaning (for example by carpet fibers being torn out).

Consequently, a dirt identification sensor used on a high-pile carpet will always detect dirt particles using a low number of double strokes, because deep-seated dirt in particular does not come loose after one or two double strokes.

While this circumstance is advantageous for some consumer groups because they have no problems with time-consuming treatment of their carpets due to their cleaning preferences, it is assumed in the context of the knowledge according to the invention that other consumer groups are more likely to be unsettled with regard to the information provided by the dirt identification sensor if it identifies dirt on high-pile carpets over a longer cleaning period.

According to the invention, in particular, a method described below and a vacuum cleaner that implements the method are therefore proposed:

The invention is based on a dirt identification sensor implemented in a cleaning appliance.

For example, this is fitted in the tube of a manually operated multi-use hand-held appliance—however, the sensor can also be fitted at a different location, for example in the nozzle, in the connecting piece or just before entry into the dust box. It can also be implemented in another cleaning appliance, such as a robotic cleaner.

The output of the dirt identification sensor is connected to the control unit (control module) of the cleaning appliance. A floor sensor (for example current sensor, which monitors the current supplied to the bristle roller) also supplies data to the control unit.

Since, for example, the power consumption on soft surfaces such as carpets increases due to the greater sinking of the nozzle and the resulting increase in resistance, current measurement sensors are very suitable for differentiating between hard and soft floors.

In order to meet the needs of different target groups, the following procedure is proposed:

The consumer can set the sensitivity of the dirt identification sensor via the menu of the cleaning appliance or via an app (selection of a mode).

If the consumer selects the sensitivity to be "high" (real mode), the dirt identification sensor displays the data as measured (dirt value on the display module)—with the consequence that more intensive cleaning, i.e. more double strokes, is required on soft surfaces—in particular high-pile carpets—than on hard floors.

However, the consumer can be informed about this via an info field (information display) so that they are aware of this fact when selecting this setting.

The values as measured are also used by the cleaning appliance control system and as soon as a specific amount of dirt (exceeding the dirt limit value) passes the dirt identification sensor, the cleaning performance (for example performance of the fan and the bristle roller) is increased for a predeterminable period of time T.

If the consumer selects the sensitivity to "Automatic" (automatic mode), the data from the floor sensor/current measurement sensor is included in the evaluation in addition to the data from the dirt identification sensor.

If the floor sensor/current measurement sensor indicates that the cleaning appliance is on a hard floor (degree of hardness below the soft floor limit value), the data from the dirt identification sensor is displayed as measured and used by the control unit of the cleaning appliance.

In addition, the power of the fan and the bristle roller is increased again for a predeterminable period of time T as soon as a specific amount of dirt passes the dirt identification sensor.

However, if the floor sensor/current measurement sensor indicates that the cleaning appliance is located on a soft floor such as a carpet (degree of hardness equal to or above the soft floor limit value), the data (dirt value) from the dirt sensor is first weighted (weighting value) before it is processed (as a reduction value) by the control unit or displayed to the consumer.

The aim of this weighting is to reduce the sensitivity of the dirt identification sensor, especially for high-pile carpets. The power of the fan and the bristle roller is then increased again for a predeterminable period of time T.

In a further embodiment of the invention, the weighting (weighting value) can be performed as a function of the degree of hardness (value of the current measurement sensor). This enables improved individual modification of the measured value (dirt value).

This then leads to a reduction in sensitivity in an area A of the dirt identification sensor by a factor of A1, while in an area B of the dirt identification sensor a reduction by the factor of B1 is made. In specific terms, a short-pile carpet can therefore be cleaned using a different sensitivity than a high-pile carpet, since the current measurement sensor indicates a higher average current requirement on the high-pile carpet than on a short-pile carpet (different degree of hardness).

In addition to the current measurement sensor, other sensor data (in particular other floor sensors) can also be included in the evaluation, in particular for example cameras and sensors that measure the distance travelled or the gaps between the cleaning appliance and objects in the household.

Their values can be analyzed and, if necessary, weighted in the same way as described in the example of the current measurement sensor.

The invention has the following advantages:

Adjustability of the sensitivity of a dirt identification sensor by the consumer. By merging the output of the dirt identification sensor with the output of a floor sensor (current measurement sensor), the sensitivity of the dirt identification sensor on different surfaces can be adjusted to suit the consumer group.

Other features which are considered as characteristic for the invention are set forth in the appended claims.

Although the invention is illustrated and described herein as embodied in a vacuum cleaner having adaptive dirt identification and a method for operating the vacuum cleaner, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
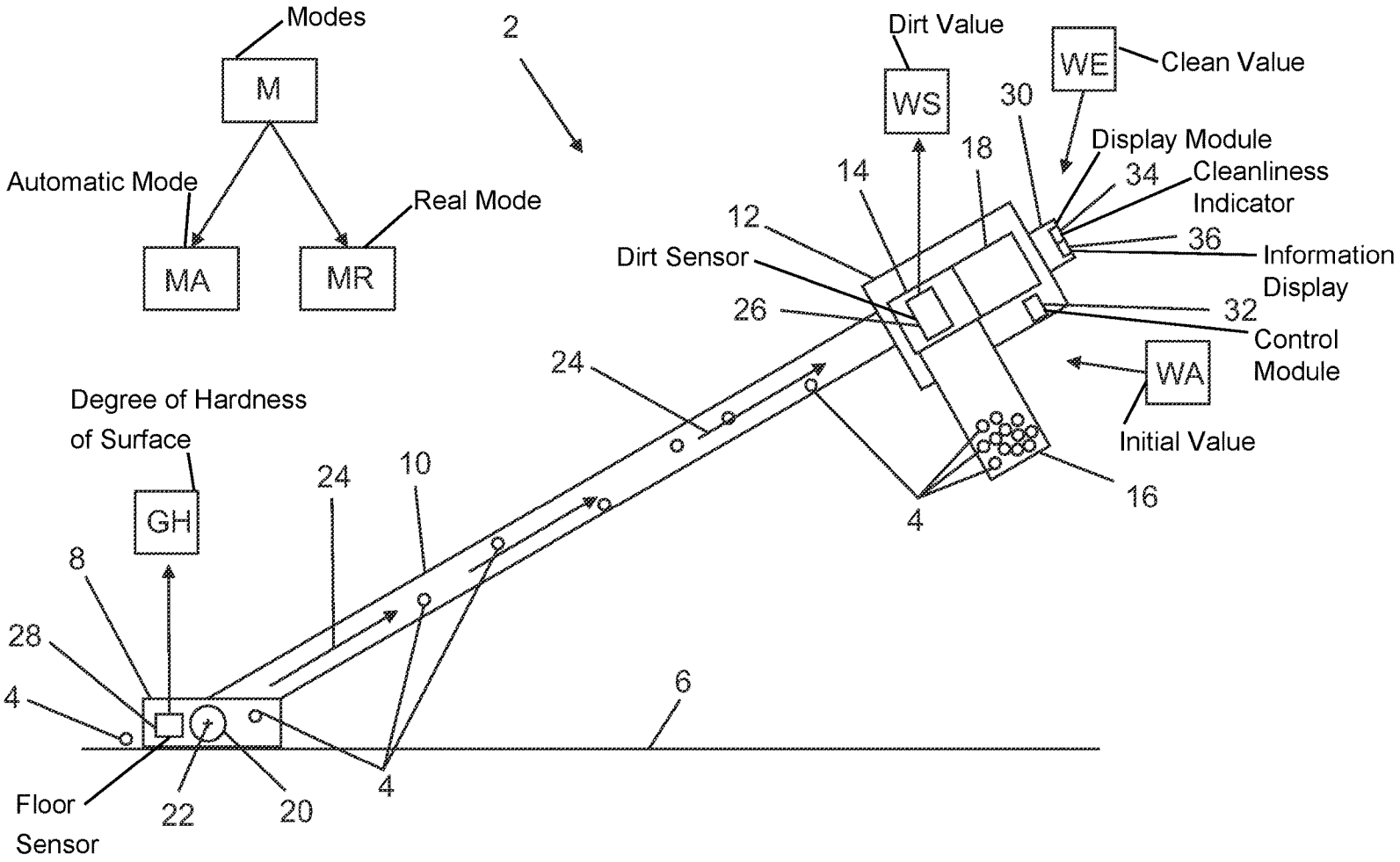
FIG. 1 is a diagrammatic, side-elevational view of a vacuum cleaner according to the invention.

Referring now to the figures of the drawings in detail and first, particularly, to FIG. 1 thereof, there is seen a vacuum cleaner 2 in the form of a multi-use hand-held appliance. During operation, the vacuum cleaner 2 is used to collect dirt 4 (shown symbolically in the form of particles) from a surface 6 that is currently being vacuumed. The vacuum cleaner 2 contains a nozzle assembly 8, which is connected to a base body 12 of the vacuum cleaner 2 via a suction pipe 10. This base body 12 contains a dust separation system 14 as well as a dust box 16 and a blower 18. The nozzle assembly 8 contains a cleaning roller 20, which rotates around an axis of rotation 22 during operation and is driven there by an electric motor (not shown) within the nozzle assembly 8.

During a dry cleaning process, in this case vacuum cleaning, the dirt 4 is picked up from the surface 6 via the nozzle assembly 8 and transported through the suction pipe 10 to the dust collection container in the form of the dust box 16. This is achieved by negative pressure or an air flow, which is generated by the fan 18. A transport path 24 of the dirt is indicated by arrows. The cleaning roller 20 rotates around the axis of rotation 22 and is equipped with bristles (not shown) and thereby additionally removes dirt 4 from the surface 6.

The vacuum cleaner 2 also contains a dirt sensor 26, which is located in the transport path 24 and is only symbolically indicated therein. During operation, the dirt sensor 26 generates a dirt value WS (only symbolically indicated in the figure). The vacuum cleaner 2 also contains a floor sensor 28, which determines a degree of hardness GH of the currently vacuumed surface 6 during operation. The vacuum cleaner 2 contains a display module 30 and a control module 32, which are also only symbolically indicated therein. The control module 32 or the vacuum cleaner 2 can be switched between different modes M, in this case an automatic mode MA and a real mode MR, which is also only symbolically indicated in FIG. 1.

Figure 2:
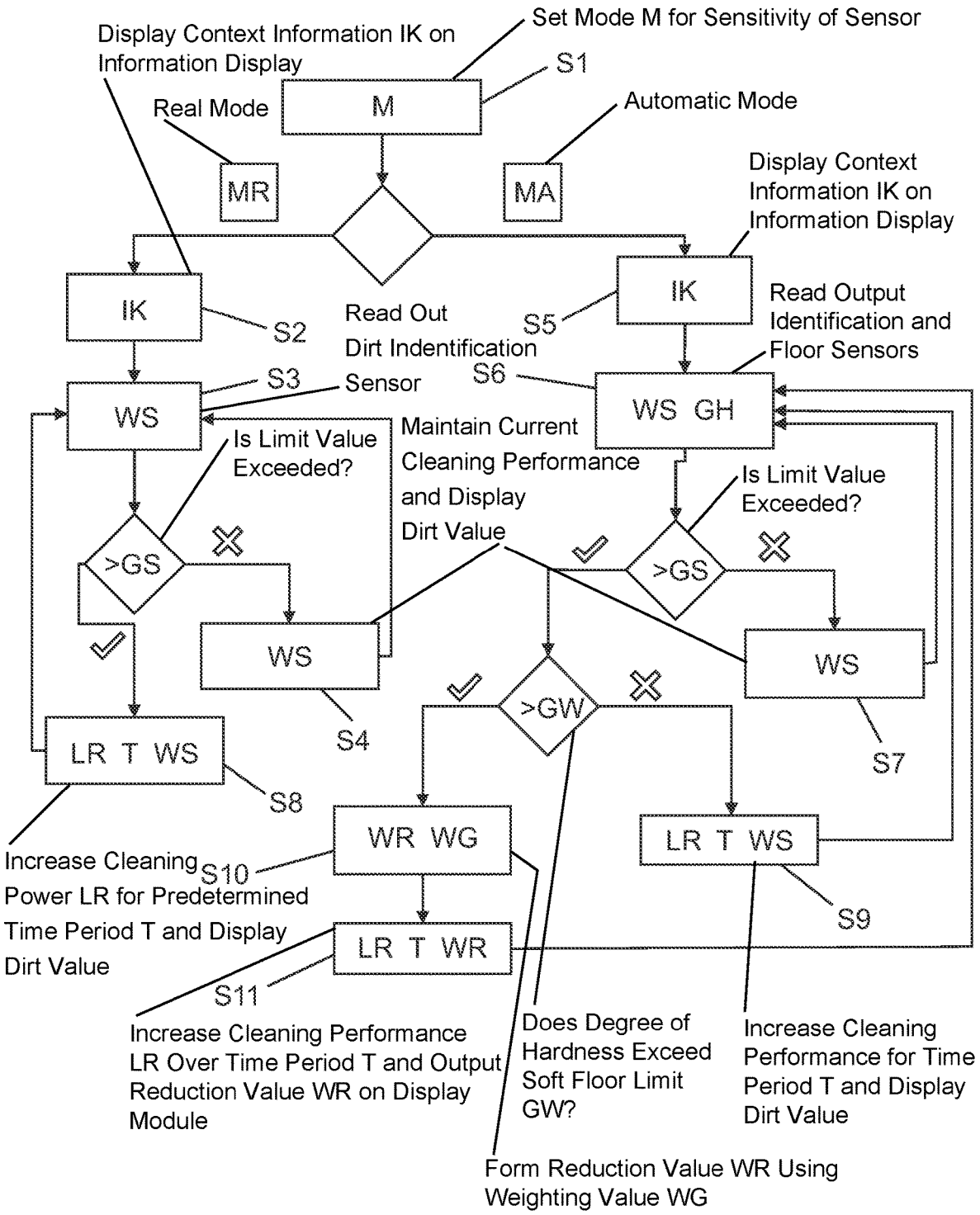
FIG. 2 is a flow chart for a method according to the invention.

FIG. 2 shows a flow chart of a method for operating the vacuum cleaner 2 of FIG. 1. First, a user (not shown) of the vacuum cleaner 2 sets the mode M on the vacuum cleaner 2, namely either the automatic mode MA or the real mode MR. This is performed in a step S1. In other words, the sensitivity of the dirt identification sensor or dirt sensor 26 is set in step S1.

In the real mode MR, the procedure is as follows:

Firstly, in a step S2, context information IK is displayed on an information display 36 of the display module 30 and thus displayed to the user. The context information IK contains information to the user or consumer regarding the selected mode M, in this case the real mode MR. In a step S3, the dirt identification sensor or dirt sensor 26 is read out. The dirt value WS read-out is now compared with a dirt limit value GS. Higher dirt values WS indicate an increased amount of dirt or more dirt 4 currently being sucked up. If the dirt limit value GS is exceeded (indicated by a check mark in FIG. 2), a lot of dirt 4 is currently being vacuumed up. In a step S8, the cleaning power LR of the vacuum cleaner 2 is increased for a predeterminable period of time T. This is based on an initial value WA of the cleaning power LR that the vacuum cleaner has at the moment before the increase, i.e. at which it is currently being operated regularly.

In other words, the power of the blower 18 and/or the cleaning roller 20 or bristle roller is in particular increased for the predeterminable time period T.

If, on the other hand, a high amount of dirt is not detected, i.e. no dirt value WS above the dirt limit value GS (marked by an X in the figure) is detected, the current cleaning performance LR (performance of the fan 18 or cleaning roller 20) is maintained in a step S4.

If, on the other hand, the user selects the automatic mode MA as the mode M in the step S1, the following steps are performed:

Firstly, in a step S5, context information IK, in this case regarding the automatic mode MA, is also output on the display module 30, i.e. information is provided to the consumer regarding the selected automatic mode MA as described above. In a step S6, both the dirt identification sensor or dirt sensor 26 and the floor sensor 28, in this case current sensors for detecting the current consumption of the motor (not shown) of the cleaning roller 20 are read out. A check is then performed again as to whether the dirt value WS exceeds the dirt value limit value GS. If this is not the case ("X"), step S7 is performed analogously to step S4 above and the cleaning performance LR of the vacuum cleaner 2 is maintained.

However, if this is the case (as indicated by a "check mark" in the figure), a check is made as to whether a soft floor is recognized, i.e. whether the degree of hardness GH exceeds a soft floor limit value GW. If this is not the case (as indicated by an "X" in the figure, i.e. detection of a hard floor), the cleaning performance LR is increased for the time period T in a step S9 analogous to step S8 above. However, if this is the case ("check mark", i.e. detection of a soft floor), a reduction value WR is formed or determined in a step S10 by multiplying the dirt value WS by a weighting value WG that is less than one. In a step S11, the cleaning performance LR is increased over the time period T in accordance with the steps S8 and S9 above, but in this case the reduction value WR is output on the display module 30. In the steps S4, S7, S8 and S9, however, the dirt value WS and not the reduction value WR is output on the display module 30.

FIG. 1 also shows symbolically that the vacuum cleaner 2 or the display module 30 also includes a cleanliness indicator 34, in this case a green light. This light is off or shows a color other than green (for example red or orange shades) as long as the dirt value WS is above (including) a clean value WE. If the value falls below the clean value WE, the cleanliness indicator lights up green. The user thus recognizes by using a binary signal that the surface currently being vacuumed is sufficiently clean, i.e. that a sufficiently low dirt value WS is present or has been reached. This allows the user to continue vacuuming another section of the surface 6.

The following is a summary list of reference numerals and the corresponding structure used in the above description of the invention.

LIST OF REFERENCE CHARACTERS

2 Vacuum cleaner
4 Dirt
6 Surface
8 Nozzle assembly
10 Suction pipe
12 Base body
14 Dust separation system
16 Dust box
18 Fan
20 Cleaning roller
22 Axis of rotation
24 Promotion route
26 Dirt sensor
28 Floor sensor
30 Display module
32 Control module
34 Cleanliness indicator
36 Information display
GH Degree of hardness
GS Dirt limit value
GW Soft floor limit value
IK Context information
LR Cleaning performance
M Mode
MA Automatic mode
MR Real mode
S1-11 Step
T Time period
WA Initial value
WE Clean value
WG Weighting value
WR Reduction value
WS Dirt value

The invention claimed is:

1. A vacuum cleaner for sucking up dirt from a surface, the vacuum cleaner comprising:

a dirt sensor configured to determine a dirt value indicating an amount of the dirt currently being sucked up;

a floor sensor configured to determine a degree of hardness indicating the hardness of a currently vacuumed surface;

a display; and a controller configured to operate in at least one automatic mode;

said controller, upon the degree of the hardness being below a soft-bottom limit value:

outputting the dirt value on said display, and otherwise determining a reduction value of the dirt value weighted by a weighting value being less than one, and outputting the reduction value on said display;

said controller configured to be switched at least between said at least one automatic mode and a real mode, and in said real mode said controller configured, upon the degree of the hardness being above the soft-bottom limit value, to output the dirt value in lieu of the reduction value on said display.

2. The vacuum cleaner according to claim 1, wherein said controller is configured to select the weighting value as a function of the degree of the hardness.

3. The vacuum cleaner according to claim 1, wherein said controller is configured to increase a cleaning performance of the vacuum cleaner based on an initial value for a predeterminable period of time, if the dirt value or the reduction value exceeds a dirt limit value.

4. The vacuum cleaner according to claim 1, which further comprises a cleaning roller, said floor sensor being configured to determine the degree of the hardness based on a current operating value of said cleaning roller.

5. The vacuum cleaner according to claim 1, wherein said display contains a cleanliness indicator indicating when the dirt value or the reduction value falls below a predeterminable cleanliness value.

6. The vacuum cleaner according to claim 1, wherein said display contains an information display displaying context information regarding a currently selected mode.

7. A method for operating a vacuum cleaner, the method comprising:

providing the vacuum cleaner, wherein the vacuum cleaner comprising: a dirt sensor configured to determine a dirt value indicating an amount of dirt currently being sucked up; a floor sensor configured to determine a degree of hardness indicating the hardness of a currently vacuumed surface; a display; and a controller configured to operate in at least one automatic mode; said controller, upon the degree of the hardness being below a soft-bottom limit value: outputting the dirt value on said display, and otherwise determining a reduction value of the dirt value weighted by a weighting value being less than one, and outputting the reduction value on said display; said controller configured to be switched at least between said at least one automatic mode and a real mode, and in said real mode said controller configured, upon the degree of the hardness being above the soft-bottom limit value, to output the dirt value in lieu of the reduction value on said display;

using said dirt sensor to determine the dirt value;

using said floor sensor to determine the degree of the hardness;

using said controller in said at least one automatic mode, upon the degree of the hardness being below the soft-bottom limit value:

to output the dirt value on said display, and otherwise to determine the reduction value and output the reduction value on said display and switching said controller at least between said at least one automatic mode and said real mode, and using said controller in said real mode to output the dirt value in lieu of the reduction value on said display, upon the degree of the hardness being above the soft bottom limit value.

* * * * *